US006416381B1

(12) United States Patent
Walter et al.

(10) Patent No.: US 6,416,381 B1
(45) Date of Patent: Jul. 9, 2002

(54) MOTION INDUCED SOUND AND LIGHT GENERATING SYSTEM

(75) Inventors: Christopher G. Walter, Walled Lake; Matt Fuligni, Northville, both of MI (US)

(73) Assignee: The Little Tikes Company, Hudson, OH (US)

( * ) Notice: Subject to any disclaimer, the term of this patent is extended or adjusted under 35 U.S.C. 154(b) by 9 days.

(21) Appl. No.: 09/639,243

(22) Filed: Aug. 15, 2000

(51) Int. Cl.[7] ..... A63H 5/00

(52) U.S. Cl. ..... 446/397; 446/298; 446/219; 472/98; 472/102

(58) Field of Search ..... 446/29, 297, 298, 446/175, 438, 219, 236, 397; 472/95, 102, 96, 98; 200/153 A, 61.52; 250/349

(56) References Cited

U.S. PATENT DOCUMENTS

| | | | | | |
|---|---|---|---|---|---|
| 2,425,975 | A | | 8/1947 | Witte et al. | 177/7 |
| 3,160,984 | A | | 12/1964 | Ryan | 46/232 |
| 3,304,651 | A | | 2/1967 | Deyerl | 46/228 |
| 3,580,575 | A | | 5/1971 | Speeth | 273/58 |
| 3,935,669 | A | | 2/1976 | Potrzuski et al. | 46/228 |
| 4,037,833 | A | | 7/1977 | Anderson | 272/52 |
| 4,094,094 | A | | 6/1978 | Ono | 46/232 |
| 4,219,962 | A | | 9/1980 | Dankman et al. | 46/232 |
| 4,662,260 | A | | 5/1987 | Rumsey | 84/1.01 |
| 4,701,750 | A | | 10/1987 | Wilkinson et al. | 340/384 E |
| 4,705,268 | A | | 11/1987 | Nadeau | 272/72 |
| 4,737,134 | A | | 4/1988 | Rumsey | 446/409 |
| 4,766,275 | A | * | 8/1988 | Hemmann et al. | 200/153 A |
| 4,801,141 | A | | 1/1989 | Rumsey | 273/1 E |
| 4,931,029 | A | | 6/1990 | Hwang | 446/396 |
| 5,045,016 | A | | 9/1991 | Stern et al. | 446/409 |
| 5,049,107 | A | | 9/1991 | De Nittis | 446/397 |
| 5,066,011 | A | | 11/1991 | Dykstra et al. | 273/58 |
| 5,074,820 | A | | 12/1991 | Nakayama | 446/29 |
| 5,221,225 | A | | 6/1993 | Newbold et al. | 446/297 |
| 5,278,414 | A | * | 1/1994 | Samuelson et al. | 250/349 |
| 5,328,410 | A | | 7/1994 | Amburgey et al. | 472/99 |
| 5,356,329 | A | | 10/1994 | Thornell | 446/485 |
| 5,421,763 | A | | 6/1995 | Amburgey et al. | 446/194 |
| 5,533,899 | A | | 7/1996 | Young | 434/61 |
| 5,635,903 | A | | 6/1997 | Koike et al. | 340/441 |
| 5,721,532 | A | * | 2/1998 | Lehmann et al. | 340/571 |

* cited by examiner

*Primary Examiner*—Kien T. Nguyen
(74) *Attorney, Agent, or Firm*—Piper Rudnick

(57) ABSTRACT

A motion sensing device for producing either an audio or a visual output includes a toy body, a motion sensor, either a sound generating device or a light generating device, and a control circuit. The motion sensor is coupled to the toy body. The motion sensor defines a cavity and has at least three contacts and a moveable object disposed in the cavity. The moveable object is positionable between at least a first position in which, the movable object bridges a first combination of two of the at least three contacts to form a first circuit input, and a second position, in which the moveable object bridges a second combination of two of the at least three contacts forming a second circuit input. The control circuit is coupled to the toy body and is electrically coupled to the motion sensor and to the generating device. The control circuit is configured to transmit a varying actuation signal to the generating device based upon the rate of change of the moveable object between the first position and the second position. In another aspect of the invention, a toy includes a toy body, a control unit, a motion sensor, either a generating device, and a control circuit. In another aspect of the invention, a control unit for a riding toy having a toy body is provided and includes a housing, a motion sensing means, a generating device, and a control circuit. The housing is removably coupled to the toy body of the riding toy.

21 Claims, 7 Drawing Sheets

MOTION INDUCED SOUND AND LIGHT GENERATING SYSTEM

FIELD OF THE INVENTION

The present invention relates generally to the field of motion induced sound and light generating devices. More particularly, the invention relates to a riding toy configured to generate sounds and lights in response to the motion of the toy.

BACKGROUND OF THE INVENTION

Children enjoy playing on riding toys, particularly toys that move in a generally cyclical motion. Children also enjoy playing with toys shaped as vehicles, animals, dinosaurs and other conventional shapes. Boys and girls alike often participate in role playing in which the child pretends to be a policeman, fireman, cowboy, cowgirl or other adult role. When playing such roles, children often simulate role related noises. For example, for a policeman role, police related sounds are often generated, such as a siren, communications with a central dispatcher and police vehicle noises. Additionally, children are especially attracted to interactive toys which produce sounds or lights in response to the child's input.

Riding toys are well known. Riding toys which produce sounds when the child depresses a pushbutton or when air is moved through the toy are also generally known. Riding toys typically resemble animals, dinosaurs or vehicles. Other toys, such as impact balls or small musical toys, which produce a sound when impacted are also known.

Existing riding toys, however, have a number of drawbacks. Such riding toys typically require the child to remove one or both hands from the handles of the riding toy in order to initiate sounds. Existing riding toys also provide only minimal interactive play options for the child. Riding toys typically produce no sound or lights in response to the child's riding of the toy. Those toys which do produce a sound when the toy is moved typically do not provide variations in the sound output of the toy based upon the child's movement of the toy.

Thus, there is a need for an improved riding toy which produces sound or light in response to the child's operation of the toy. It would also be advantageous to provide a riding toy that produces varying signals based upon the motion imparted by the child to the riding toy. What is needed is riding toy which interacts with the child's actions and is safe, fun and easy for children to use.

SUMMARY OF THE INVENTION

According to a principal aspect of the invention, a motion sensing device for producing at least one of an audio and a visual output includes a toy body, a motion sensor, either a sound generating device or a light generating device, and a control circuit. The motion sensor is coupled to the toy body. The motion sensor defines a cavity and has at least three contacts and a moveable object disposed in the cavity. The sound generating device or the light generating device is coupled to the toy body. The control circuit is coupled to the toy body and is electrically coupled to the motion sensor and to either the sound generating device or the light generating device. The control circuit is configured to transmit a varying actuation signal to either the sound generating device or the light generating device based upon the rate of change of the moveable object within the cavity.

According to another aspect of the invention, a toy includes a toy body, a control unit, a motion sensor, either a sound generating device or a light generating device and a control circuit. The motion sensor is coupled to the control unit. The motion sensor defines a cavity has a first and second set of contacts and a moveable object disposed in the cavity. The moveable object is positionable between at least a first position in which, the movable object bridges the first set of contacts, and a second position, in which the moveable object bridges the second set of contacts. The sound generating device or the light generating device is coupled to the toy body. The control circuit is coupled to the control unit and is electrically coupled to the motion sensor and to either the sound generating device or the light generating device. The control circuit is configured to transmit a varying actuation signal to either the sound generating device or the light generating device based upon the rate of change of the moveable object between the first position and the second position.

According to another aspect of the invention, a control unit for a riding toy having a toy body is provided. The control unit includes a housing, a motion sensing means, either a sound generating device or a light generating device, and a control circuit. The housing is removably coupled to the toy body of the riding toy. The motion sensing means and, either the sound generating device or the light generating device, are coupled to the housing. The control circuit is coupled to the housing and is electrically coupled to the motion sensing means and to either the sound generating device or the light generating device. The control circuit is configured to transmit, during operation, a varying actuation signal to either the sound generating device or the light generating device based upon the rate of generally cyclical motion of the toy body.

According to another aspect of the invention, a toy includes a toy body, a motion sensor, either a sound generating device or a light generating device and a control circuit. The motion sensor is coupled to the control unit. The motion sensor defines a cavity. The motion sensor has at least three contacts and a moveable object disposed in the cavity. The sound generating device or the light generating device is coupled to the toy body. The control circuit is coupled to the toy body and is electrically coupled to the motion sensor and to either the sound generating device or the light generating device. The control circuit is configured to transmit a signal to either the sound generating device or the light generating device. The signal has a characteristic based upon the duration of the moveable object.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
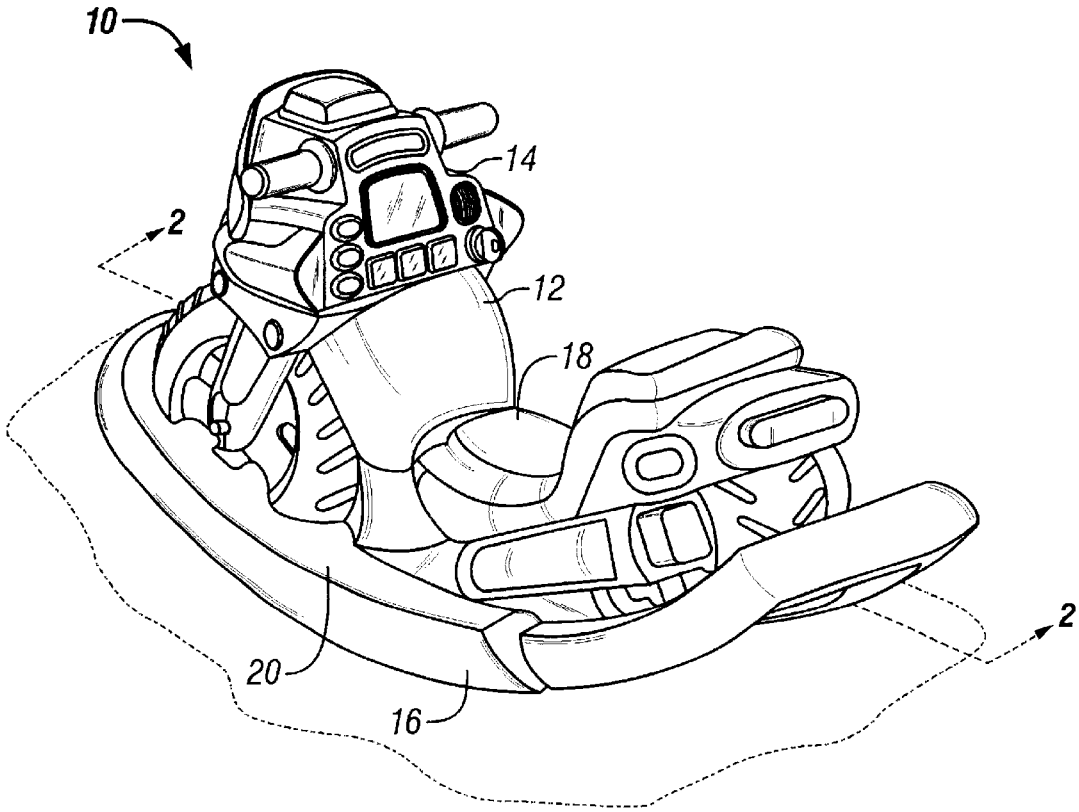
FIG. 1 is a perspective view of a riding toy in accordance with the present invention.

Referring to FIG. 1, a perspective view of a motion induced sound and light generating riding toy constructed in accordance with a preferred embodiment of the present invention is shown generally at 10. The riding toy 10 generally includes a toy body 12 and a control unit 14. The toy body 12 is formed in the shape of a vehicle, specifically a motorcycle, but alternatively, can be formed in other conventional shapes, such as an animal, a dinosaur and other vehicles.

Figure 2:
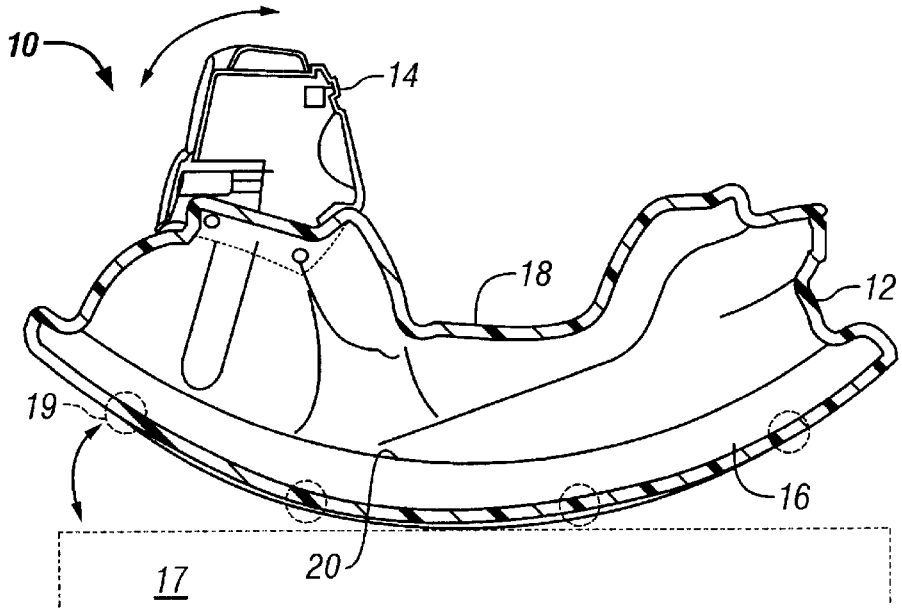
FIG. 2 is a cross-sectional view of the riding toy taken substantially along line 2—2 of FIG. 1.

As best shown in FIG. 2, the toy body 12 includes an arcuate lower portion 16 for contacting a generally flat or generally horizontal surface 17, and a seat portion 18. The arcuate lower portion 16 of the toy body 12 outwardly extends from a left side and a right side of the toy body 12 to form a set of foot rests 20 (only one of the two are shown in FIGS. 1 and 2). The lower portion 16 is configured for enabling the riding toy 10 to produce a fore and aft rocking motion. Alternatively, the toy body 12 of the riding toy 10 can be configured to produce other types of motion such as a rolling motion, sliding motion, a roll or a wobble. The seat portion 18 is generally centrally positioned on an upper portion of the toy body 12. The seat portion 18 is configured for supporting a child during operation of the riding toy 10. The toy body 12 is made of molded plastic, but alternatively, can be made of other materials such as wood, fiberglass, metal and styrafoam. The toy body 12 provides a structure for safe and easy operation by children, including small children. In an alternative preferred embodiment, the toy body 12 includes at least one handle configured for grasping by the child during operation of the riding toy 10. In another alternative preferred embodiment, the toy body 12 can include one or more additional components such as a set of wheels 19 to enable the toy body 12 to roll, reflectors, lights, wings, mirrors, pushbuttons, ornamental extensions and other conventional items.

Figure 3:
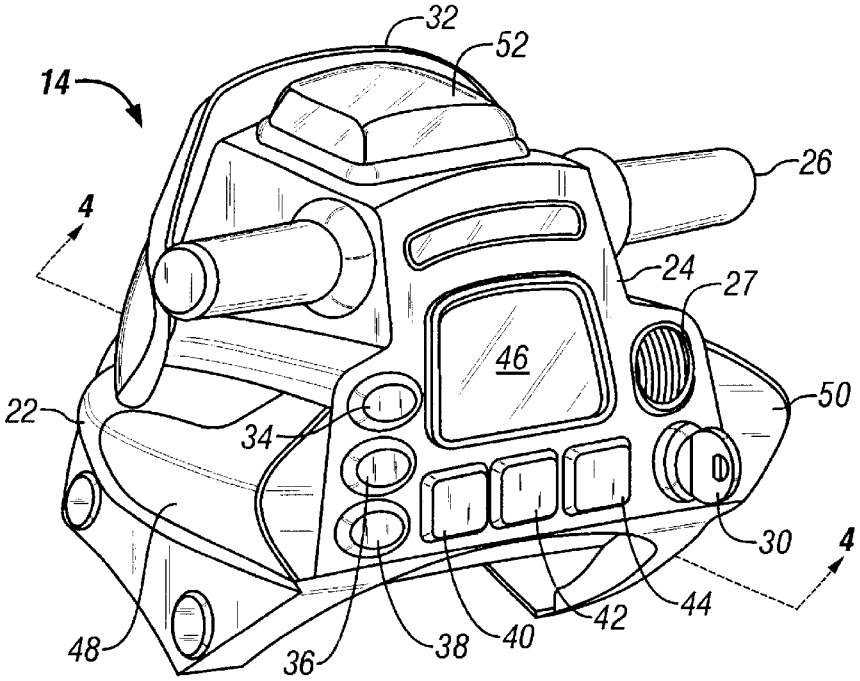
FIG. 3 is a perspective view of a control unit of the riding toy of FIG. 1.

As best shown in FIGS. 2 and 3, the control unit 14 includes a housing. The control unit 14 is coupled to the upper portion of the toy body 12. In a preferred embodiment, the control unit 14 is slidably and removably connected to the toy body 12. The control unit 14 is configured to provide a structure for supporting one or more control and accessory devices. The control unit 14 is also configured to provide a hand grip for the child during operation of the riding toy 10. The control unit 14 is preferably formed from a front housing section 22 and a rear housing section 24. In an alternative preferred embodiment, the control unit 14 has a single housing. The control unit 14 is preferably made of molded plastic, but alternatively, can be made of other materials such as wood, fiberglass and metal. The control unit 14 provides a single, generally compact structure for supporting the controls and accessory devices of the riding toy 10. In a preferred embodiment, the control unit 14 is configured for removably mounting onto more than one toy body 12 enabling the user to transfer the control unit 14 to another toy body having an alternative shape, thereby increasing the overall versatility of the control unit 14 and the riding toy 10. The control unit 14 can be produced, transported, marketed, replaced and stored separately from the toy body 12. The compact size of the control unit 14 relative to the size of the toy body 12 enables control unit 14 to be easily removed, stored and replaced enabling a user to, for example, store the toy body 12 outdoors and the control unit 14 indoors.

Figure 5:
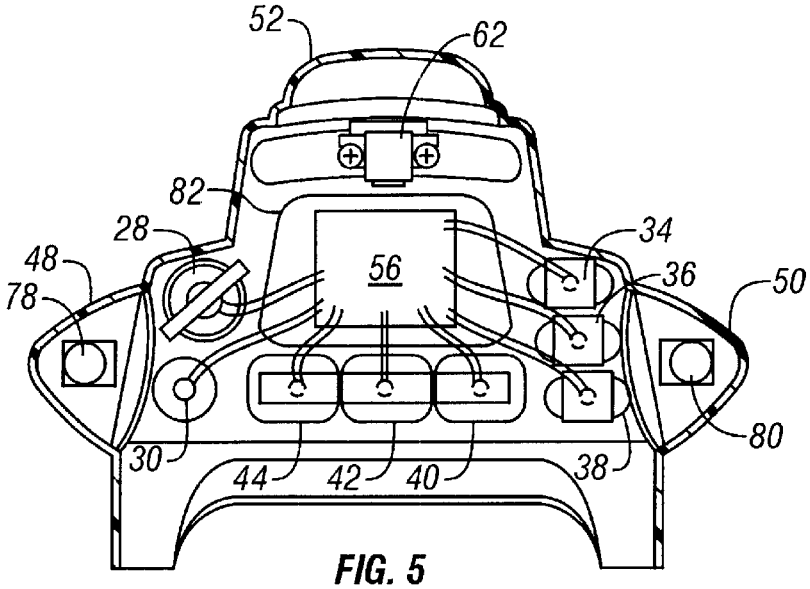
FIG. 5 is a cross-sectional view of the control unit taken substantially along line 5—5 of FIG. 4.

Referring to FIG. 3, the control unit 14 includes a set of handles 26, at least one pushbutton, at least one light, a switch 30, a front shield 32 and openings 27 for a sound transducer 28 (shown on FIG. 5). The handles 26 are elongate extensions extending from the housing of the control unit 14. In a preferred embodiment, the handles 26 are formed from extensions of the front and rear housing sections 22, 24. The handles 26 are configured to provide a location for grasping of the riding toy 10 by the child. In alternative preferred embodiments, the handles 26 can be made in other forms such as, a steering wheel, an animal's ears, an animal's horns, wings or other conventional extension.

In a preferred embodiment, the control unit 14 includes six pushbuttons: a siren button 34, a horn button 36, an engine simulation button 38, and first, second and third voice activation buttons 40, 42, 44, respectively. The pushbuttons 34, 36, 38, 40, 42, 44 are conventional electronic pushbuttons coupled to the rear housing section 24 of the control unit 14. As shown in FIG. 5, each pushbutton 34, 36, 38, 40, 42, 44 is electrically coupled to a printed control board 56 ("PCB") Referring to FIG. 3, a portion of each of the pushbuttons 34, 36, 38, 40, 42, 44 extends through an opening within the rear housing section 24. Each of the pushbuttons 34, 36, 38, 40, 42,44 is a switch, which when depressed by a child, sends a voltage signal to a PCB 56 ("PCB") (shown on FIG. 5) resulting in a sound or a series of sounds being generated from the sound transducer 28. The siren button 34, when depressed, is configured to produce sounds simulating a siren. Similarly, the horn button 36 produces horn sounds, the engine simulation button 38 produces engine revving sounds, and the first, second, and third pushbuttons 40, 42, 44 produces human voice sounds, for example, "calling officer, report to headquarters", "we have an emergency, please investigate," and "mission accomplished, good job," respectively. The control unit 14 can readily be configured to produce alternative sounds. In a preferred embodiment, when one of the first, second and third pushbuttons 40, 42, 44 is depressed, a rear light 60 (shown on FIG. 4) is lit.

In a preferred embodiment, the control unit 14 includes four lights, as shown in FIG. 3. Each light includes a cover element: the rear light cover 46, a left light cover 48, a right light cover 50 and a top light cover 52. The lights are configured to illuminate upon receipt of a signal from the PCB 56 (shown on FIG. 4).

The motion sensing feature of the control unit 14 is initiated by operation of the switch 30 (see FIG. 3). The switch 30 is a conventional spring-return switch. The switch 30 is shaped to resemble an ignition switch with a key placed in it. A portion of the switch 30 extends through an opening in the rear housing section 24 of the control unit 14. The switch 30 is connected to the rear housing section 24. When actuated by the child, or other user, the switch 30 sends a voltage signal to the PCB 56 (shown on FIG. 4) resulting in a sound or a series of sounds being generated from the sound transducer 28, in initiation of the motion sensing feature of the control unit 14, and in illuminating at least one of the lights.

Figure 4:
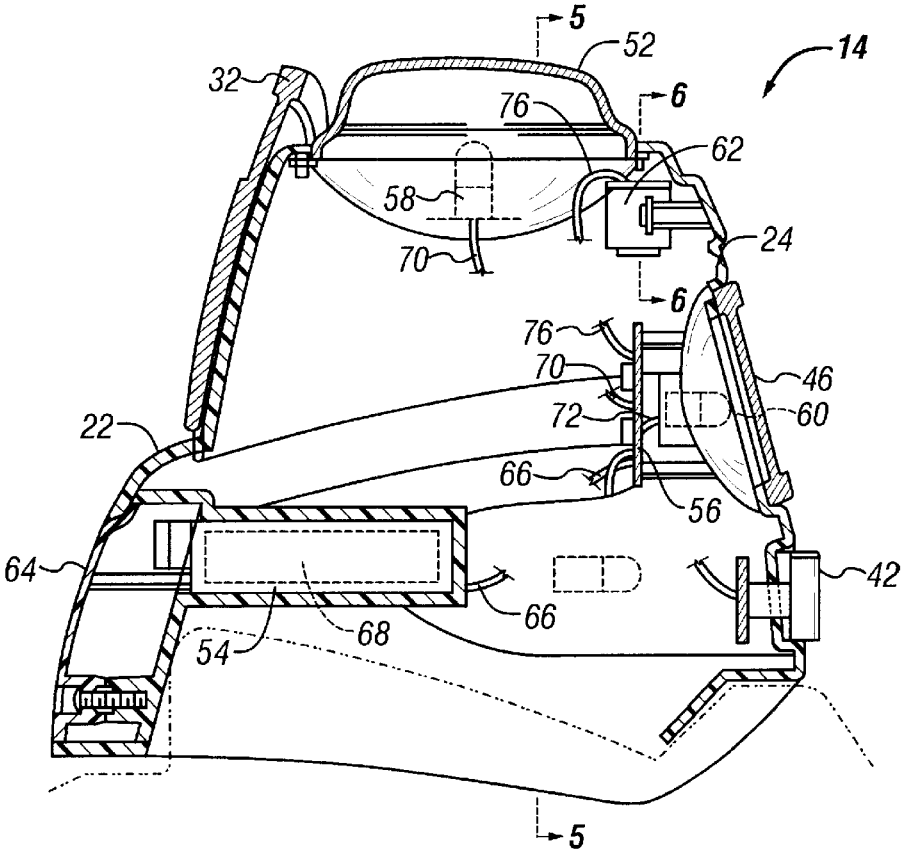
FIG. 4 is a cross-sectional view of the control unit taken substantially along line 4—4 of FIG. 3.

FIG. 4 illustrates the control unit 14 in greater detail. The control unit 14 further includes a battery case 54, a top light 58, the rear light 60, the PCB 56, and the motion sensor 62. The battery case 54 is formed into and inwardly extends from the front housing section 22 of the control unit 14 and includes a removable battery case cover 64. The battery case 54 is electrically coupled to the PCB 56 by a first wiring connection 66. The battery case 54 is configured to hold a set of batteries 68 for powering the control unit 14. In a most preferred embodiment, the batteries 68 comprise three, 1.5 Volt, "AA" size batteries to produce a 4.5 Volt power supply for the control unit 14. Alternate power supplies and battery sizes can be utilized.

The top and rear lights 58, 60 are conventional light bulbs, preferably comprising light emitting diodes. The top and rear lights 58, 60 are mounted to the front and rear housing sections 22, 24, and are electrically coupled by second and third wiring connections 70, 72, to the PCB 56, respectively. The top and rear lights 58, 60 generate light in response to signals from the PCB 56.

The PCB 56 is a printed circuit board preferably connected to the rear housing section 24 of the control unit 14. The PCB 56 is electrically coupled to the pushbuttons 34, 36, 38, 40, 42, 44, the lights, the sound transducer 28, the battery case 54, and the motion sensor 62. In a preferred embodiment, the conventional PCB 56 has part number PT-1073A, 000308.

The motion sensor 62 is a motion sensing device. The motion sensor 62 is connected to the rear housing section 24 and is electrically coupled to the PCB 56 through a fourth wiring connection 76.

FIG. 5 illustrates the control unit 14 in further detail. The control unit includes the sound transducer 28, a left light 78 and a right light 80. The sound transducer 28, also referred to as a speaker, is a sound generating device. The sound transducer 28 is mounted to the rear housing section 24 of the control unit 14 adjacent to openings 27, and is electrically coupled by a fifth wiring connection 82 to the PCB 56. The sound transducer 28 generates sounds in response to signals from the PCB 56. The sounds generated by the sound transducer 28 can include vehicle related sounds, sirens, horns, human voices and other conventional sounds. In a preferred embodiment, the sound transducer is a 16 ohm speaker. The sound transducer 28 can also be of alternate resistance.

The left and right lights 78, 80 are light bulbs, preferably comprising light emitting diodes. The left and right lights 78, 80 are mounted to the front housing section 22, and are electrically coupled to the PCB 56, respectively. The left and right lights 78, 80 generate light in response to signals from the PCB 56.

Figure 6:
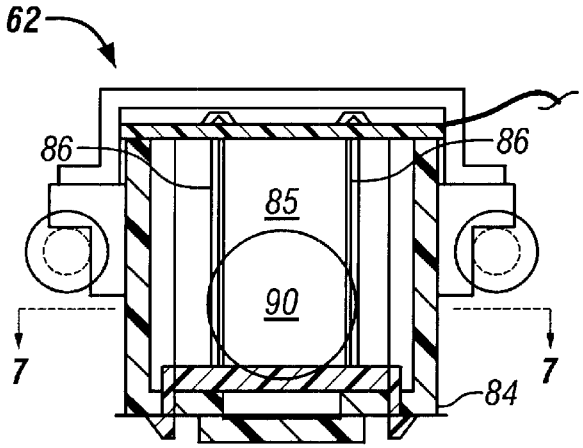
FIG. 6 is a cross-sectional view of a motion sensor of the control unit taken substantially along line 6—6 of FIG. 4.
Figure 7:
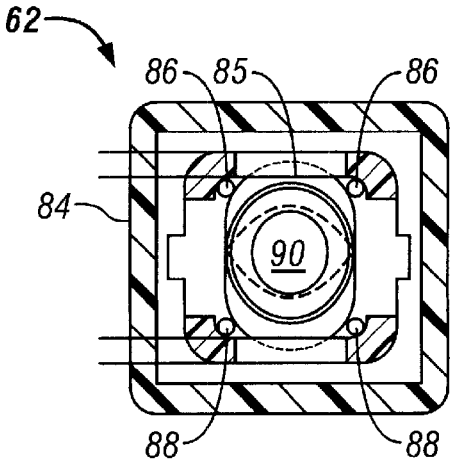
FIG. 7 is a cross-sectional view of the motion sensor of the control unit taken substantially along line 7—7 of FIG. 6.

FIGS. 6 and 7 illustrate the motion sensor 62 in greater detail. The motion sensor 62 includes a housing 84 defining a cavity 85, four pins forming first and second sets of contacts 86, 88, respectively, and a ball 90. The first and second sets of contacts 86, 88 are made of a conductive material. The first and second sets of contacts 86, 88 are spaced apart, and the ball 90 is sized, such that the ball 90 can bridge only one set of contacts at anytime. Each contact of the first and second sets of contacts 96, 88 is disposed in an approximate vertical position and extend parallel to one another. The first and second sets of contacts 86, 88 are electrically coupled to the PCB 56 at first and second motion sensor inputs, respectively.

The ball 90 is a spherical object disposed within the cavity 85 between the first and second sets of contacts 86, 88. The ball 90 is made of a conductive material, preferably metal. The ball 90 is positionable between a first position in which, the ball 90 bridges the first set of contacts 86, and a second position, in which the ball 90 bridges the first set of contacts 88. The PCB 56 then produces an output signal to the sound transducer 28 and to the lights in response to the contact of the ball 90 to one of the set of contacts 86, 88 and also produces varying signals to the sound transducer 28 and to the lights based upon the rate of contact of the ball 90 with the first and second sets of contacts 86, 88. The motion sensor 62 is configured to transmit a signal to the PCB 56 which causes the PCB 56 to send a varying signal to the sound transducer 28 and to the lights, based upon the rate of change of the ball 90 between the first and second positions of the ball 90.

The variable signal sent from the PCB 56 to the sound transducer 28 and the lights enables the riding toy 10 to directly respond and interact with the motion imparted by the child to the riding toy 10. The control unit 14 enables a child to control the output of the sound transducer 28 or the lights 58, 60, 78, 80 based upon the child's rate of rocking of the toy rider. In a preferred embodiment, as the child increases the rate of rocking of the riding toy 10, the control unit 14 emits a louder and different series of sounds from the sound transducer 28 and causes the lights 58, 60, 78, 80 to flash.

In alternative embodiments, the motion sensor 62 can include three or more contacts forming at least two sets of contacts and at least two circuit inputs to the PCB 56. The ball 90 can be made of alternate shapes such as a cylinder, an irregular shape and a baton. In an alternative embodiment, the motion sensor 62 can be a mercury switch.

Figure 8A:
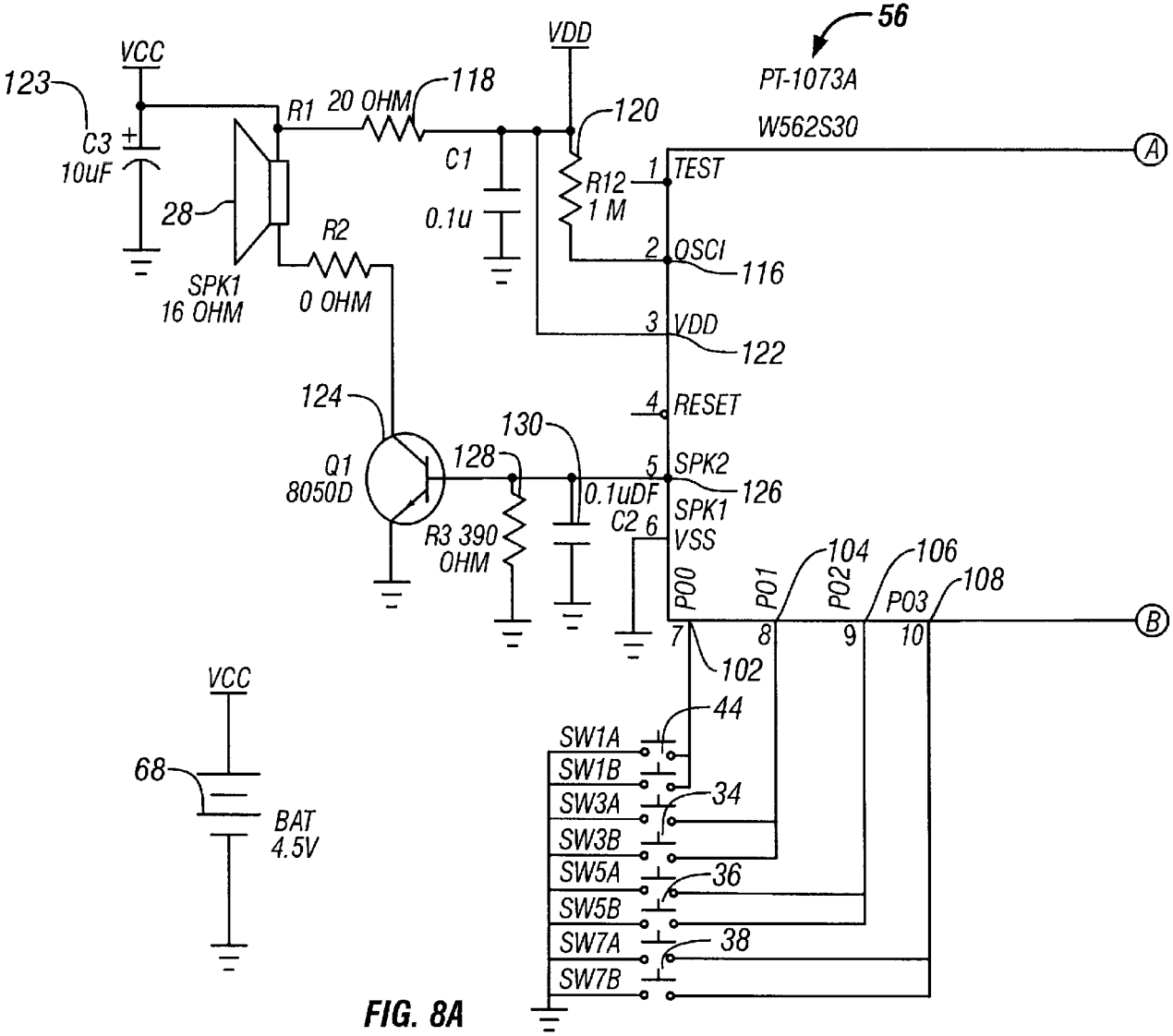
FIGS. 8A and 8B are electronic circuit diagram of the control system of the control unit.
Figure 8B:
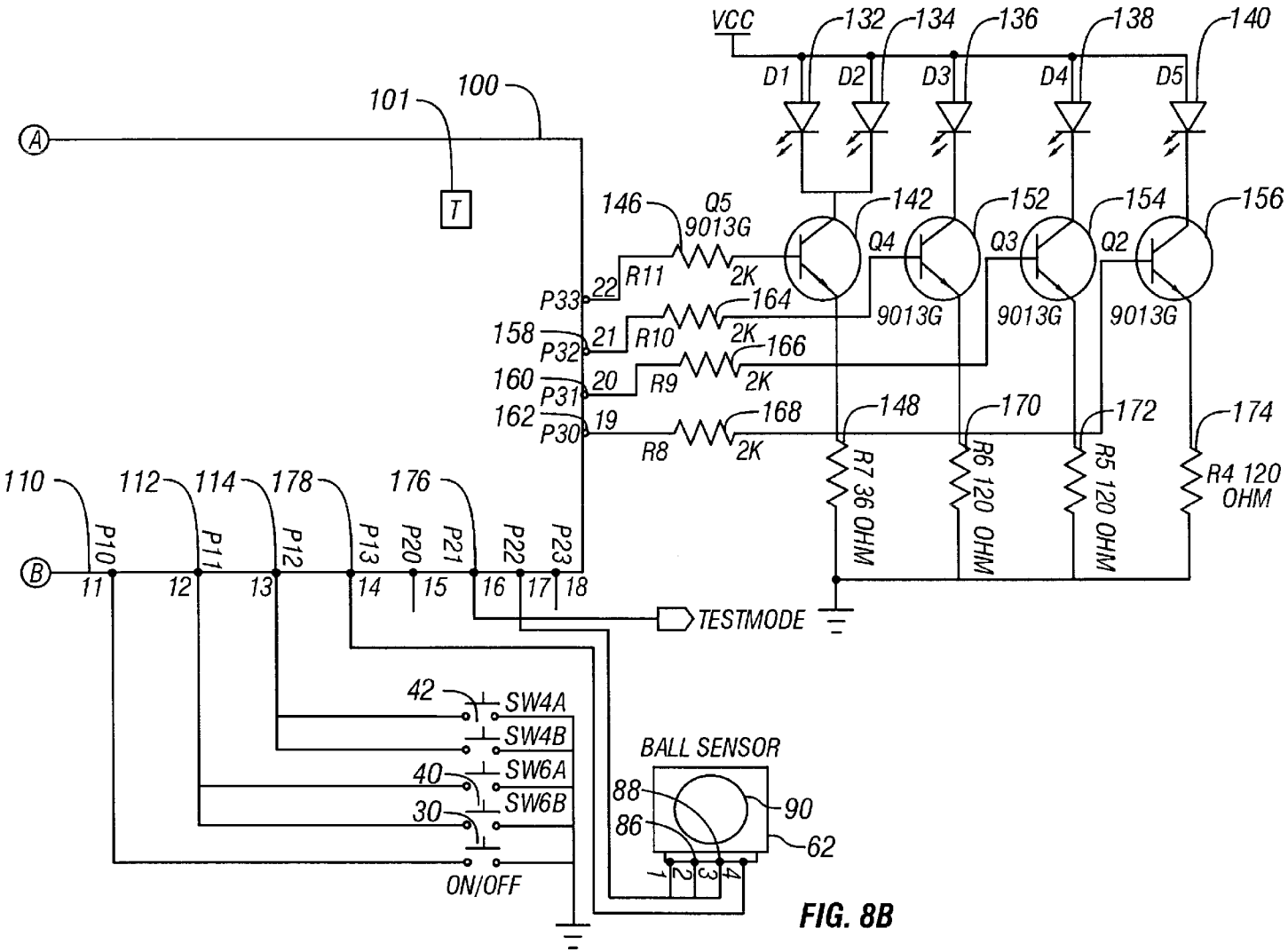

Referring to FIGS. 8A and 8B, a preferred embodiment of a circuit diagram for the control unit 14 is illustrated. The PCB includes a circuit comprising a microprocessor 100, or microcontroller, capable of synthesizing several different human sounds and vehicle sounds, and signaling the lights 58, 60, 78, 80 to flash. The microprocessor 100 includes an internal timer 101. An example of such a chip is the conventional Winbond BandDirector™ microprocessor model number W562S30. Alternate microprocessors or microcontrollers can be used. The microprocessor 100 is actuated by the switch 30 and the pushbuttons 34, 36, 38, 40, 42, 44. The switch 30 and the pushbuttons 34, 36, 38, 40, 42, 44 are connected to trigger inputs 110, 104, 106, 108, 112, 114, 102 of the microprocessor 100, respectively, such that when the switch 30 or one of the pushbuttons 34, 36, 38, 40, 42, 44 triggers the associated trigger input, the microprocessor 100 generates and outputs a transducer controlling signal which corresponds to the switch or the pushbutton chosen.

The microprocessor 100 is powered by a power supply (the batteries 68). The collective positive end of the batteries 68 is connected to: a first voltage input 116 of the microprocessor 100 through the resistors 118, 120 connected in series; and a second voltage input 122 through the resistor 118. The positive end of the batteries 68 is also connected to the sound transducer 28 and a capacitor 123. The sound transducer 28 then connects to the collector of a first transistor 124. The emitter of the first transistor 124 is connected to ground and the base of the first transistor is connected to a speaker input 126. The base of the first transistor 124 is also connected to a resistor 128 and a capacitor 130. The battery 68 also connects to first, second, third, fourth and fifth light emitting diodes 132, 134, 136, 138, 140. The first and second diodes 132, 134 are connected in parallel to the collector of a second transistor 142. The base of the second transistor 142 connects to a first light input 144 through a resistor 146. The emitter of the second transistor is connected to ground through a resistor 148. The third, fourth and fifth diodes 136, 138, 140 are connected to the collector of the third, fourth and fifth transistors 152, 154, 156, respectively. The base of the third, fourth and fifth transistors 152, 154, 156 are connected to second, third and fourth light inputs 158, 160, 162 through a resistor 164, a resistor 166 and a resistor 168, respectively. The emitter of the third, fourth and fifth transistors 152, 154, 156 are connected to ground through a resistor 170, a resistor 172 and a resistor 174, respectively. The first and second sets of contacts 86, 88 of the motion sensor 62 are connected to first and second motion sensor inputs 176, 178, respectively.

When the microprocessor 100 outputs a sound signal through the speaker connection 126, the sound signal is transmitted to the base of the first transistor 124 enabling current to flow through the sound transducer 28. The sound signal from the speaker connection 126 controls the sound transducer 28 causing it to produce human voice sounds or vehicle related sounds. When the micoprocessor 100 outputs a light signal through one of the diodes 132, 134, 136, 138, 140, the light signal is transmitted through the base of the second, third, fourth and fifth transistors 142, 152, 154, 156 enabling current to flow through the diodes 132, 134, 136, 138, 140, respectively. The current flow through one of the diodes 132, 134, 136, 138, 140 causes one of the lights 58, 60, 78, 80 to flash.

When the ball 90 of the motion sensor 62 bridges the first set of contacts 86 an input signal is sent to the first motion sensor input 176, and when the ball 90 of the motion sensor 62 bridges the second set of contacts 88, an input signal is sent to the second motion sensor input 178. The microprocessor 100 sends sound and light signals to the sound transducer 28 and the diodes 132, 134, 136, 138, 140. These signals vary based upon the rate of contact by the ball 90 alternatingly bridging the first and second sets of contacts 86, 88.

Figure 9:
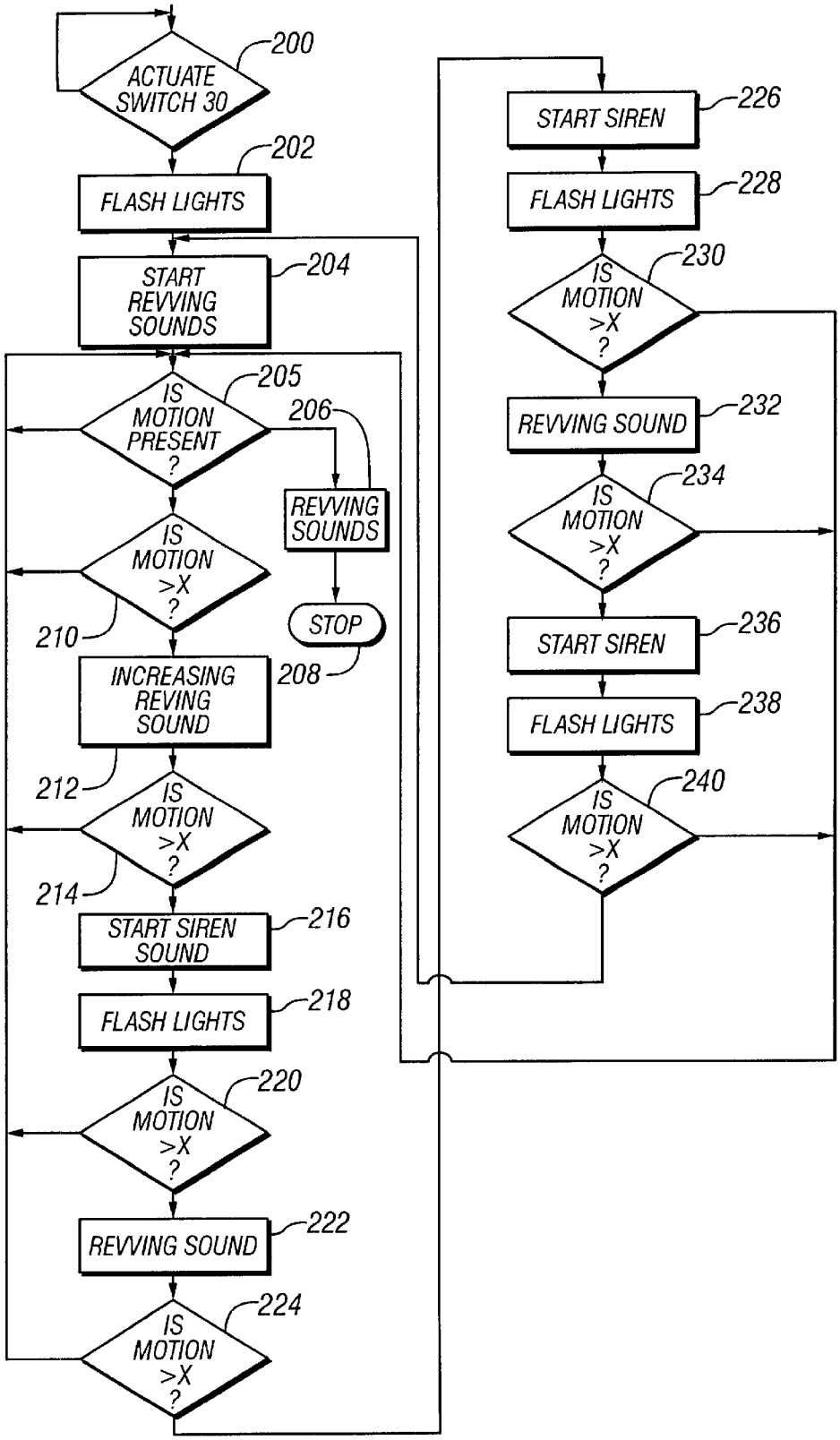
FIG. 9 is a flow chart showing one preferred embodiment of the logic of the control system of the control unit during operation.

Referring to FIG. 9, one preferred embodiment of the control system logic of the microprocessor 100 is illustrated. Other logic sequences are conventionally available and would be known to a person of ordinary skill in the art. The switch 30 is activated by the user, indicated at 200. The microprocessor 100 sends a signal to the left, right and upper lights 78, 80, 58 causing the lights 78, 80, 58 to flash and the internal timer 101 of microprocessor 100 to energize, indicated at 202. The microprocessor 100 sends a signal to the sound transducer 28 causing an engine revving sound to be produced, indicated at 204. The microprocessor 100 senses whether the riding toy 10 is rocking, indicated at 205. If no rocking motion is present, engine revving sounds continue to be produced for approximately 10 seconds, indicated at 206 and the sound transducer 28 stops, indicated at 208. This is accomplished through use of the internal timer 101 of microprocessor 100. When the internal timer of the microprocessor 100 reaches a first timer event, the signal to the sound transducer 28 ceases. In a preferred embodiment, the first timer event is approximately 10 seconds. If some rocking motion is present, the microprocessor 100 determines if the motion is sufficient to produce the next series of output signals, indicated at 210. If rocking motion is present, but the rocking motion is below a predetermined amount of rocking (or rate of motion or rate between bridging by the ball 90 of the first set of contacts 86 and then the second sets of contacts 88), the revving sounds, indicated at 204, are continued. If the rocking motion is greater than the predetermined amount of rocking, a revving sound of increasing volume is produced for approximately 20 seconds, indicated at 212. Once the predetermined amount of rocking is reached, the microprocessor 100 produces a signal causing revving sounds at an increased volume to be produced until a second timer event is reached. In a preferred embodiment, the second timer event is approximately 20 seconds. The microprocessor 100 then determines if the amount of rocking is greater than the predetermined level, indicated at 214. If the amount of rocking is less than the predetermined level, the microprocessor 100 returns to the step indicated at 205. If the amount of rocking is greater than the predetermined level, the microprocessor 100 causes the sound transducer 28 to produce siren sounds, indicated at 216 and the left, right and top lights 78, 80, 58 to flash, indicated at 218. When the rocking motion continues beyond the duration of second timer event, the microprocessor 100 causes the sound transducer 28 to produce siren sounds until a third timer event is reached. In a preferred embodiment, the third time event is approximately 10 seconds. The microprocessor 100 determines if the amount of rocking is greater than the predetermined level, indicated at 220. If the amount of rocking is less greater than the predetermined level, the microprocessor 100 returns to the step indicated at 205. If the amount of rocking is greater than the predetermined level, the microprocessor 100 causes the sound transducer 28 to produce an engine revving sound until a fourth time event is reached, indicated at 222. In a preferred embodiment, the fourth timer event is approximately 10 seconds.

The microprocessor 100 determines if the amount of rocking is greater than the predetermined level, indicated at 224. If the amount of rocking is less than the predetermined level, the microprocessor 100 returns to the step indicated as 205. If the amount of rocking is greater than the predetermined level, the microprocessor 100 causes the sound transducer 28 to produce siren sounds, indicated at 226 and the left, right and top lights 78, 80, 58 to flash for approximately 10 seconds, indicated at 228. The microprocessor 100 then determines if the amount of rocking is greater than the predetermined level, indicated at 230. If the amount of rocking is less than the predetermined level, the microprocessor 100 returns to the step indicated at 205. If the amount of rocking is greater than the predetermined level, the microprocessor 100 causes the sound transducer 28 to produce an engine revving sound for approximately 20 seconds, indicated at 232. The microprocessor 100 determines if the amount of rocking is greater than the predetermined level, indicated at 234. If the amount of rocking is less than the predetermined level, indicated at 234. If the amount of rocking is less than the predetermined level, the microprocessor 100 returns to the step indicated at 205. If the amount of rocking is greater than the predetermined level, the microprocessor 100 causes the sound transducer 28 to produce siren sounds for approximately 10 seconds, indicated at 236 and the left, right and top lights 78, 80, 58 to flash, indicated at 238. The microprocessor 100 then determines if the amount of rocking is greater than the predetermined level, indicated at 240. If the amount of rocking is less than the predetermined level, the microprocessor 100 returns to the step indicated at 205. If the amount of rocking is greater than the predetermined level, the microprocessor 100 returns to the step indicated at 204.

Figure 10:
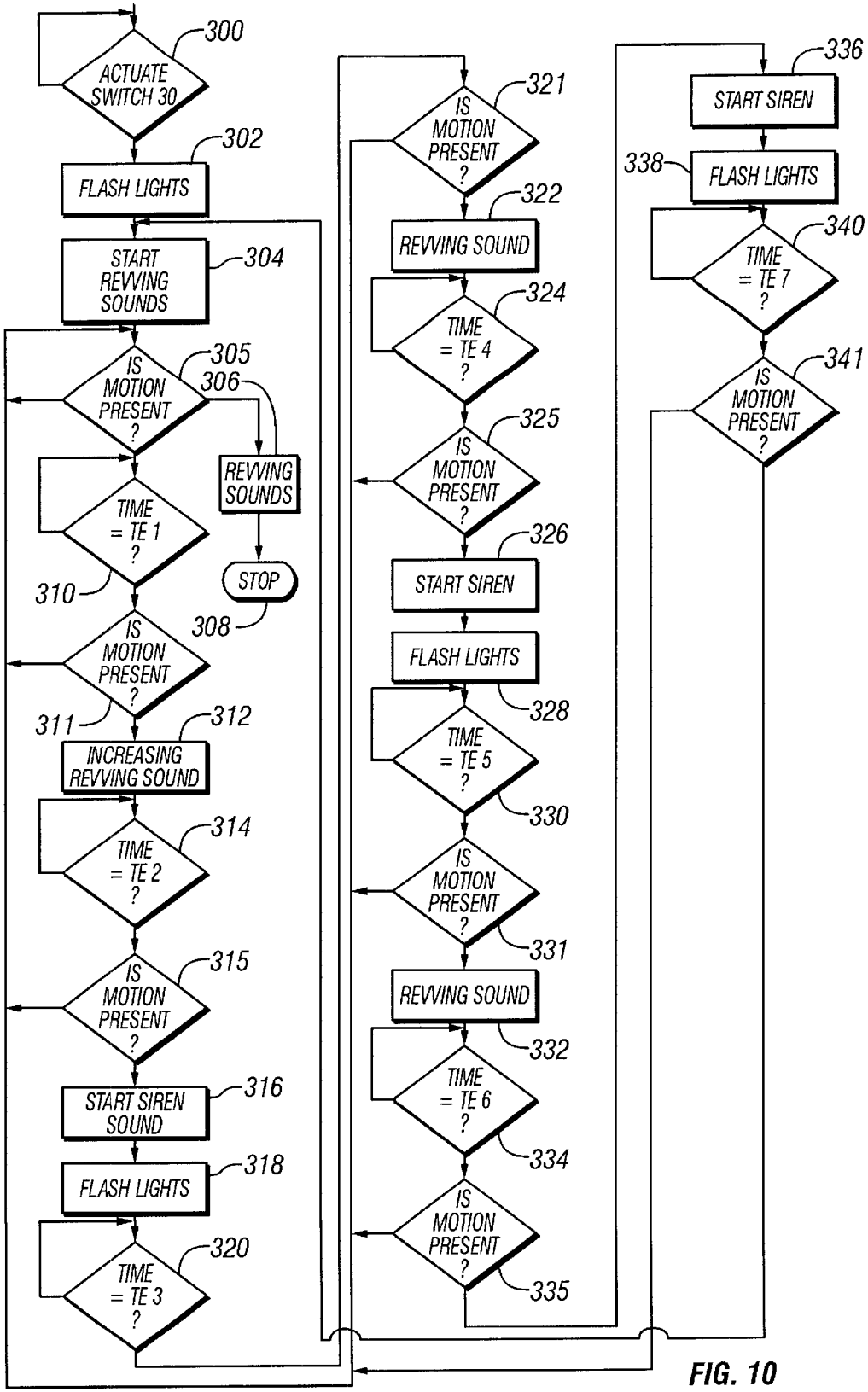
FIG. 10 is a flow chart showing another preferred embodiment of the logic of the control system of the control unit during operation.

Referring to FIG. 10, another embodiment of the control system logic of the microprocessor 100 is illustrated. The switch 30 is activated by the user, indicated at 300. The microprocessor 100 sends a signal to the left, right and upper lights 78, 80, 58 causing the lights 78, 80, 58 to flash and the internal timer 101 of microprocessor 100 is to energize, indicated at 302. The microprocessor 100 sends a signal to the sound transducer 28 causing an engine revving sound to be produced, indicated at 304. The microprocessor 100 then determines if motion is present, indicated at 305. If no rocking motion is present, engine revving sounds continue to be produced for approximately 10 seconds, indicated at 306, and the sound transducer 28 stops, indicated at 308. If rocking motion is present, the microprocessor 100 then determines if the elapsed time equals timer event 1, preferably 10 seconds from the actuation of the switch 30, indicated at 310. If no motion is present, the microprocessor returns to step 305, indicated at 311. If the rocking motion is present, a revving sound of increasing volume is produced, indicated at 312. The microprocessor 100 then determines if elapsed time is equal to timer event 2, preferably approximately 20 seconds after timer event 1, indicated at 314. The microprocessor 100 then determines if motion is present, indicated at 315. If motion is not present, the microprocessor 100 returns to step 305. If motion is present, the microprocessor 100 causes the sound transducer 28 to produce siren sounds, indicated at 316 and the left, right and top lights 78, 80, 58 to flash, indicated at 318. The microprocessor 100 determines if the elapsed time is equal to timer event 3, indicated at 320. The microprocessor 100 then determines if motion is present, indicated at 321. If motion is not present, the microprocessor 100 returns to step 305. If motion is present, the microprocessor 100 causes the sound transducer 28 to produce an engine revving sound, indicated at 322.

The microprocessor 100 then determines if the elapsed time is equal to the timer event 4, indicated at 324. The microprocessor 100 then determines if motion is present, indicated at 325. If motion is not present, the microprocessor 100 returns to the step indicated as 305. If motion is present, the microprocessor 100 causes the sound transducer 28 to produce siren sounds, indicated at 326 and the left, right and top lights 78, 80, 58 to flash, indicated at 328. The microprocessor 100 then determines if the elapsed time equals time event 5, indicated at 330. The microprocessor 100 then determines if motion is present, indicated at 331. If motion is not present, the microprocessor 100 returns to step 305. If motion is present, the microprocessor 100 causes the sound transducer 28 to produce an engine revving sound, indicated at 332. The microprocessor 100 then determines if the elapsed time equals timer event 6, indicated at 334. The microprocessor 100 then determines if motion is present, indicated at 335. If motion is not present, the microprocessor 100 returns to step 305. If motion is present, the microprocessor 100 causes the sound transducer 28 to produce siren sounds, indicated at 336, and the left, right and top lights 78, 80, 58 to flash, indicated at 338. The microprocessor 100 then determines if the elapsed time is equal to timer event 7, indicated at 340. If motion is not present, the microprocessor 100 returns to step 305. If motion is present, the microprocessor 100 returns to the step indicated as 304.

The logic of microprocessor 100 enables the riding toy 10 to produce varying sounds and intermittent lights over an extended period of time, until the child stops operating the riding toy 10. In an alternative embodiment, the microprocessor 100, can generate sound and light signals based upon the rate of motion of the riding toy 10 wherein more than one predetermined level of motion is required. In yet another embodiment, the microprocessor 100, sends sound and light signals which are proportional to the amount of rocking motion of the riding toy 10.

While a preferred embodiment of the present invention has been described and illustrated, numerous departures therefrom can be contemplated by persons skilled in the art, for example, the riding toy 10 can include modular control units positioned in more than one location on the toy body 12 of the riding toy 10. Therefore, the present invention is not limited to the foregoing description but only to the scope and spirit of the appended claims.

What is claimed is:

1. A motion sensing device for producing at least one of an audio and a visual output, the device comprising:

a toy body;

a motion sensor coupled to the toy body, the motion sensor defining a cavity, the motion sensor having at least three contacts and a moveable object disposed in the cavity;

at least one of a sound generating device and a light generating device coupled to the toy body; and a control circuit coupled to the toy body and electrically coupled to the motion Se or and to the at least one of the sound generating device and the light generating device, the control circuit transmitting a signal to the at least one of the sound generating device and the light generating device, the signal having a characteristic based upon the rate of change of the moveable object within the cavity.

2. The motion sensing device of claim 1, wherein the moveable object is positionable between at least a first position in which the movable object bridges a first combination of two of the at least three contacts to form a first circuit input, and a second position, in which the moveable object bridges a second combination of two of the at least three contacts forming a second circuit input.

3. The motion sensing device of claim 1, wherein the moveable object is made of conductive material.

4. The motion sensing device of claim 1, wherein the moveable object is a metal ball.

5. The motion sensing device of claim 1, wherein the sound generating device is a sound transducer and wherein the light emitting device is at least one light emitting diode.

6. The motion sensing device of claim 1, wherein the signal is a varying actuation signal causes the sound generating device to produce a series of vehicle related sounds.

7. The motion sensing device of claim 1 wherein the toy body is selected from the group consisting of a rocking device, a climbing device, a rolling device, a swing, and a sliding device.

8. A toy comprising:

a toy body;

a control unit removably connected to the toy body;

a motion sensor coupled to the control unit, the motion sensor defining a cavity, the motion sensor having a first and second set of contacts and a moveable object disposed in the cavity, the moveable object positionable between at least a first position in which, the movable object bridges the first set of contacts, and a second position, in which the moveable object bridges the second set of contacts;

at least one of a sound generating device and a light generating device coupled to the control unit; and a control circuit coupled to the control unit and electrically coupled to the motion sensor and to the at least one of the sound generating device and the light generating device, the control circuit transmitting a varying actuation signal to the at least one of the sound generating device and the light generating device based upon the rate of change of the moveable object between the first position and the second position.

9. The toy of claim 8, wherein the toy is a riding toy and wherein the toy body includes a seat.

10. The toy of claim 9, wherein the toy body has an arcuate lower surface.

11. The toy of claim 10, wherein the toy body is in the shape of a motorcycle.

12. The toy of claim 9, wherein the control unit includes at least one handle.

13. The toy of claim 8, wherein the toy body is in the shape of a vehicle.

14. The toy of claim 8, further comprising a battery operated power supply coupled to the control unit and electrically coupled to the control circuit.

15. A control unit for a toy having a toy body, the control unit comprising:

a housing removably coupled to the toy body of the riding toy;

motion sensing means coupled to the housing;

at least one of a sound generating device and a light generating device coupled to the housing; and a control circuit coupled to the housing and electrically coupled to the motion sensing means and to the at least one of the sound generating device and the light generating device, the control circuit transmits, during operation, a varying actuation signal to the at least one of the sound generating device and the light generating device based upon the rate of generally cyclical motion of the toy body.

16. The control unit of claim 15, wherein the motion sensing means includes a first and second set of contacts and positionable contact means, the moveable object positionable between at least a first position in which, the movable object bridges the first set of contacts, and a second position, in which the moveable object bridges the second set of contact.

17. The control unit of claim 15 wherein the housing includes at least one handle.

18. A motion sensing device for producing at least one of an audio and a visual output, the device comprising:

a toy body;

a motion sensor coupled to the toy body, the motion sensor defining a cavity, the motion sensor having at least three contacts and a moveable object disposed in the cavity;

at least one of a sound generating device and a light generating device coupled to the toy body; and a control circuit coupled to the toy body and electrically coupled to the motion sensor and to the at least one of the sound generating device and the light generating device, the control circuit transmitting a signal to the at least one of the sound generating device and the light generating device, the signal having a characteristic based upon the duration of motion of the moveable object.

19. A toy comprising:

a toy body shaped as a vehicle;

a control unit removably connected to the toy body, wherein a portion of the control unit resembles a dash board;

a motion sensor coupled to the control unit, the motion sensor defining a cavity, the motion sensor having a first and second set of contacts and a moveable object disposed in the cavity, the moveable object positionable between at least a first position in which, the movable object bridges the first set of contacts, and a second position, in which the moveable object bridges the second set of contacts;

at least one of a sound generating device and a light generating device coupled to the control unit; and a control circuit coupled to the control unit and electrically coupled to the motion sensor and to the at least one of the sound generating device and the light generating device, the control circuit configured to transmit a varying actuation signal to the at least one of the sound generating device and the light generating device based upon the rate of change of the moveable object between the first position and the second position.

20. A toy comprising:

a toy body shaped as a vehicle;

a control unit removably connected to the toy body;

a motion sensor coupled to the control unit, the motion sensor defining a cavity, the motion sensor having a first and second set of contacts and a moveable object disposed in the cavity, the moveable object positionable between at least a first position in which, the movable object bridges the first set of contacts, and a second position, in which the moveable object bridges the second set of contacts;

at least one of a sound generating device and a light generating device coupled to the control unit; and a control circuit coupled to the control unit and electrically coupled to the motion sensor and to the at least one of the sound generating device and the light generating device, the control circuit configured to transmit a varying actuation signal to the at least one of the sound generating device and the light generating device based upon the rate of change of the moveable object between the first position and the second position, wherein the control unit includes at least one light and a plurality of pushbuttons, the pushbuttons configured to cause the sound generating device of the control unit to emit one of a sound and a series of sounds.

21. The toy of claim 20, wherein the control unit is configured to produce a series of sounds selected from the group consisting of: a siren, a horn, words, engine sounds, and a combination thereof.

* * * * *